United States Patent [19]

Compagnone née Chatenay

[11] Patent Number: 4,652,046

[45] Date of Patent: Mar. 24, 1987

[54] RETRACTABLE FOLDING CHAIR

[76] Inventor: Catherine M. Compagnone née Chatenay, 70 rue Mouffetard, 75005 Paris, France

[21] Appl. No.: 760,921

[22] Filed: Jul. 31, 1985

[30] Foreign Application Priority Data

Aug. 14, 1984 [FR] France ..... 8412792

[51] Int. Cl.[4] ..... B60P 3/38

[52] U.S. Cl. ..... 297/15; 297/17

[58] Field of Search ..... 297/15, 17, 14; 296/66

[56] References Cited

U.S. PATENT DOCUMENTS

| | | | |
|---|---|---|---|
| 254,325 | 2/1882 | Jackson | 297/15 |
| 255,868 | 4/1882 | Johnson et al. | 297/15 |
| 1,062,010 | 5/1913 | Jacobson | 297/15 X |
| 1,173,351 | 2/1916 | Herington | 297/15 |
| 1,887,947 | 11/1932 | Savale | 297/15 |
| 3,453,025 | 7/1969 | Grant | 297/15 X |
| 3,927,911 | 12/1975 | Rosquist | 297/15 |

FOREIGN PATENT DOCUMENTS 7326 of 1909 United Kingdom ..... 297/15

*Primary Examiner*—Peter A. Aschenbrenner

*Attorney, Agent, or Firm*—Fisher, Christen & Sabol

[57] ABSTRACT

The invention relates to a retractable chair adapted to be folded from its active position in which the back and the leg elements are substantially in vertical position, the seat (buttocks support) being in horizontal position, towards a compact, retracted position, characterized in that the seat and the back are articulated on each other and are foldable to occupy retracted positions (folded one against the other) along adjacent, parallel planes, the seat and the back are furthermore fast with lateral leg elements themselves mounted to pivot on a lower support or box, the fact of pivoting the leg elements taking the chair constituted by the back, the seat and the leg elements in parallel horizontal planes brought substantially to floor level. The invention is more particularly applicable to equipping halls which may be used empty with a bare floorboard, or filled with rows of chairs.

6 Claims, 7 Drawing Figures

RETRACTABLE FOLDING CHAIR

The present invention relates to a retractable chair folding down into a lower box of which the cover corresponds substantially to floor level, the fact of folding the chair to a level lower than the level of the floor enabling the interior of the room or hall to be totally cleared.

The invention will be more particularly usable for halls intended for social or collective occasions and which must consequently be polyvalent to a certain extent, depending on the needs and uses.

Such halls are used for two major functions:

on the one hand, for those where the people gathered together are to remain seated in rows of seats;

on the other hand, such halls are frequently used for occasions in which the company remains standing, free to circulate (receptions, dances, for example); in such cases, the floor must be completely cleared.

At the present time, in order to respond to such conflicting needs, folding chairs are used which are stored outside when the hall is required to be empty and which are carried into the hall and opened out in situ when the hall is to be used for meetings, theatrical shows or the like, with rows of seats.

However, folding chairs are far from being comfortable for the audience or participants. In addition, the fact of displacing the chairs and positioning them, then folding them up and returning them to the storage premises necessitates a large number of staff and involves a considerable amount of time. This solution also requires the availability of annexed premises, necessarily or preferably not too remote from the hall and where the folding chairs may be stored.

It is an object of the invention to overcome this drawback by providing a foldable chair system which avoids the disadvantages of the heretofore known folding chairs.

The object of the invention is to enable a room or hall to be used for one or the other of its functions (bare floor or rows of chairs) with a minimum of manipulations to pass from one function to the other and in any case without requiring expensive displacements, toilsome for the personnel.

To this end, the invention relates to a system of retractable chairs adapted to be stored in situ in retracted position beneath the floor, consequently leaving the floor surface completely clear without necessitating transport of the chair itself when it is opened into active position.

To this end, the invention relates to a retractable chair adapted to be folded from its active position in which the back and the leg elements are substantially in vertical position, the seat (buttocks support) being in horizontal position, towards a compact, retracted position, characterized in that the seat and the back are articulated on each other and are foldable to occupy retracted positions (folded one against the other) along adjacent, parallel planes, the seat and the back are furthermore fast with lateral leg elements articulated at their base on the edges of a box adapted to receive and contain the assembly constituted by the seat, the back and the leg elements, in folded position along parallel horizontal planes.

The invention will be more readily understood on reading the following description with reference to the accompanying drawings, in which.

Figure 1:
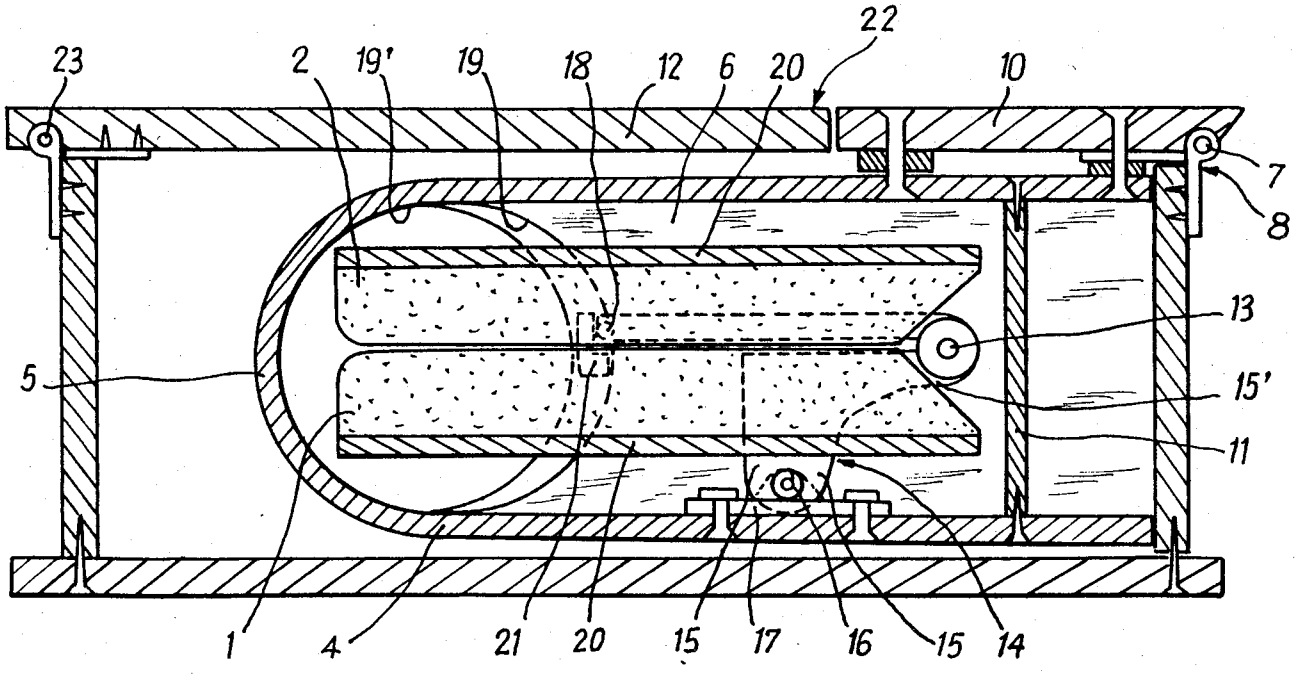
FIG. 1 shows a view in longitudinal section through the chair according to the invention, in compact position, folded down inside its receiver box.

Referring now to the drawings, the chair is composed of a seat 1 proper for supporting the buttocks, a back 2 and a leg member itself constituted by two lateral leg elements 3 and 3' respectively.

Each leg element is constituted by a lateral panel 6, 6' reinforced by jambs 4, 4', joining at their tops in a bow 5, the assembly constituting a lateral leg element being adapted to support the foldable assembly formed by the seat 1 proper and the back 2.

The two lateral leg elements 3 and 3' supporting the seat/back assembly are remounted to pivot about the swivel axis 7 on the edge 8 of a box 9, adapted to receive the chair in its compact, retracted position as shown in FIG. 1, and this via the rear plate 10.

The two leg elements 3 and 3' are connected together by the rear plate 10 and by an inner crosspiece 11.

The box 9 is constituted by lateral walls disposed vertically and its upper part is open, being closed at least partially by cover 12.

Figure 2:
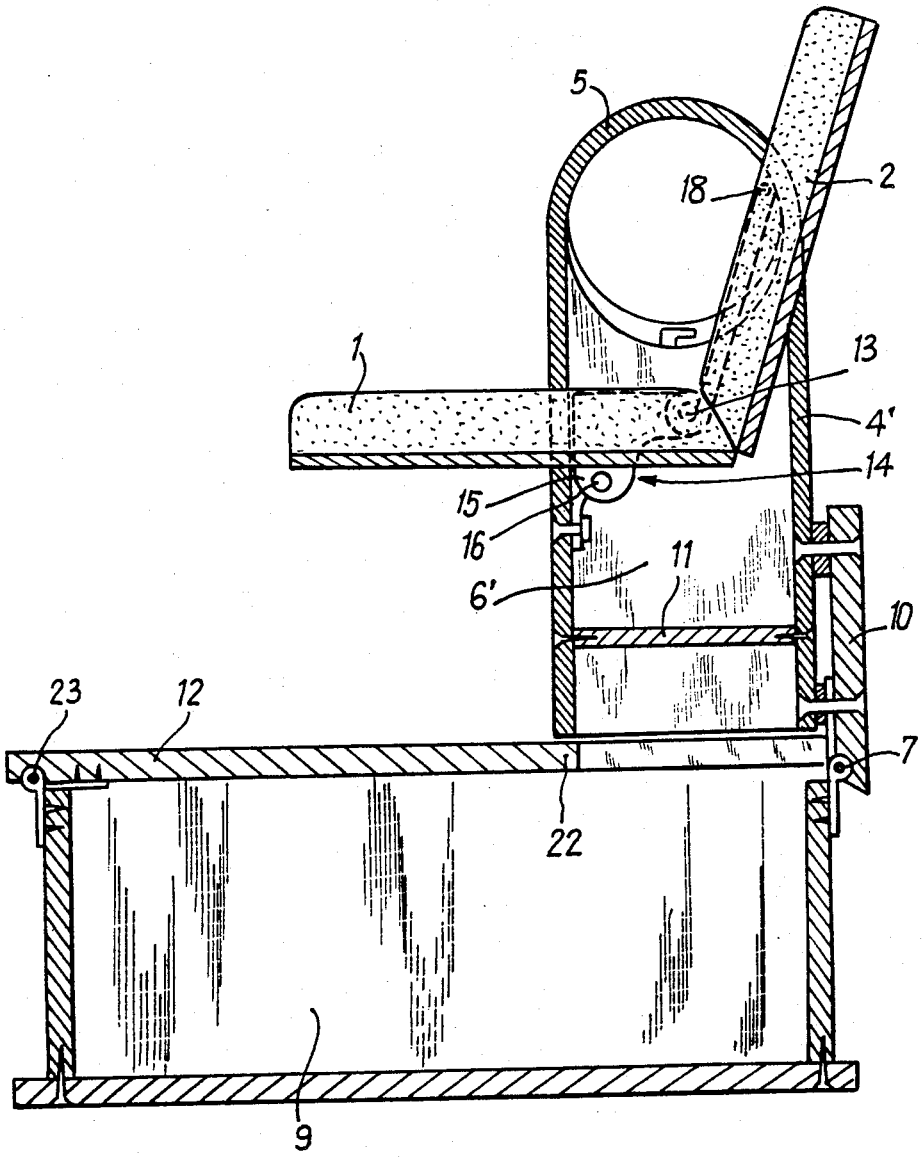
FIG. 2 shows the chair of FIG. 1 in longitudinal section, when in its opened out position.

FIG. 1 shows the chair in its compact position folded down inside the box 9, whilst FIG. 2 shows the chair in its unfolded position, corresponding to its active position.

The passage from one position to the other is effected as shown in FIGS. 3, 4, 5 and 6 thanks to the seat 1 and back 2 being articulated and mounted to pivot with respect to each other, constituting two flaps movable angularly about the pivot pin 13.

This pivot pin 13 is itself mounted at the end of an arm of an L-shaped support bracket 14.

The assembly comprises two pivot pins 13 disposed laterally, each of these pivot pins being supported by a lateral bracket 14 therefore disposed on each side and each supported by the lateral leg elements 3 and 3'.

A first arm 15 of the L-shaped bracket 14 is itself pivoted about the pivot pin 16 on the support 17 fast with a lateral leg element 3 and more especially with jamb 4.

The opposite arm 15' of the bracket 14 receives the pivot pin 13 between the seat 1 and the back 2.

It will be seen that the passage from the opened out position to the folded down position, and vice versa, is effected by angular movements of the bracket 14 of which arm 15, in its opened out position, tips angularly to come into abutment along the jamb 4 (FIG. 2), the opposite arm 15' then being mounted at right angles with respect to jamb 4.

In this movement, the pivot pin 13 is moved upwardly, this corresponding to a passage of the seat/back assembly from a low (and compact) position to an opened out position.

The back comprises on each side a stop cooperating with a bearing surface 19 provided inside the panel 6 belonging to the corresponding leg element and on which the stop 18 is guided by a cam effect.

This results in the movement of spacing apart the seat 1 and the back 2 necessarily causing the rise of the assembly and consequently facilitating pivoting of the bracket 14 brought from its retracted position (FIG. 1) to its active position (FIG. 2).

Figure 3:
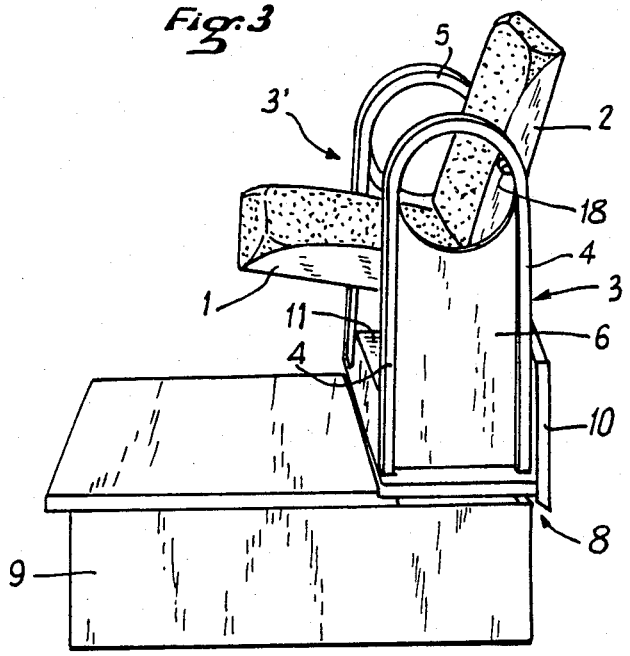
FIG. 3 shows a view in perspective of the chair on its supporting box in its opened out position.

In the open position of the chair, as shown in FIG. 3, the stop 18 rests on the rear part of the bearing surface 19 which then corresponds, on extending it, to the inner part of the bow 5.

In this position, the back 2 is therefore blocked rearwardly and may support the weight of the user's back.

The maximum degree of opening of the seat 1 with respect to the back 2 is given by the bevelled form of the cushions corresponding respectively to the seat and to the back of which the rigid rear parts 20 (for example made of laminated wood) are brought into position of abutment one against the other.

The stop 18 in the position of closure and retraction as shown in FIG. 1 may be imprisoned in a housing 21, thus blocking the whole.

The passage from the open position to the compact, retracted position will be readily understood on studying FIGS. 3, 4, 5 and 6.

This movement is effected in a first phase by folding the seat 1 against the back 2; in this movement, the stop 18 sliding along its bearing surface 19 guides the whole of the movement possibly accompanied by a downward pressure by the user so that closure of the two flaps constituting the seat and the back is accompanied by the pivoting of the bracket 14 about its axis 16, at the same time as the two seat/ back flaps close along pivot 13.

Figure 4:
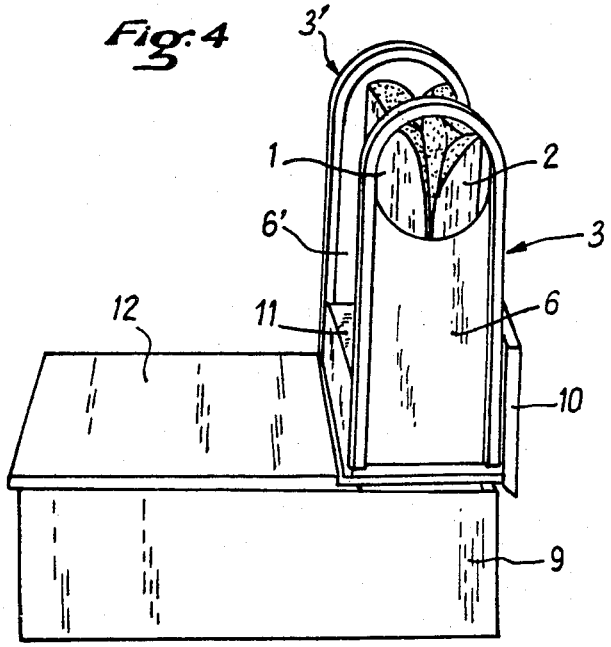
FIG. 4 shows a view of the chair of FIG. 1 in a position where the seat is folded against the back, corresponding to a first phase of the folded position.

Referring now to FIG. 4, the leg elements are vertical and the two seat/back flaps are returned into position inside the two leg elements.

Figure 5:
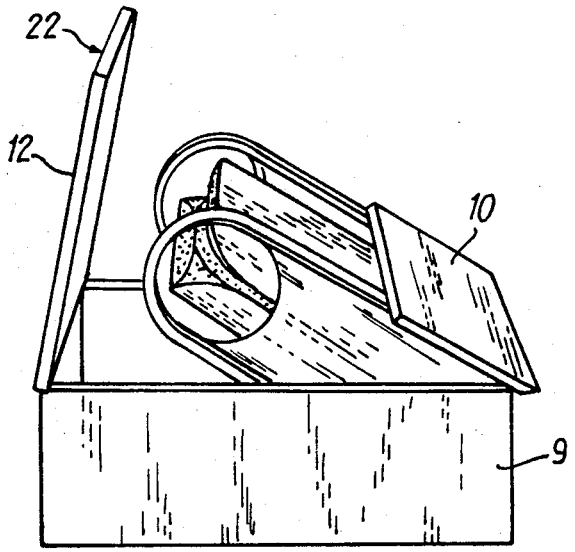
FIGS. 5 and 6 show views in perspective showing two subsequent phases of the movement of folding and retraction of the chair inside the box.
Figure 6:
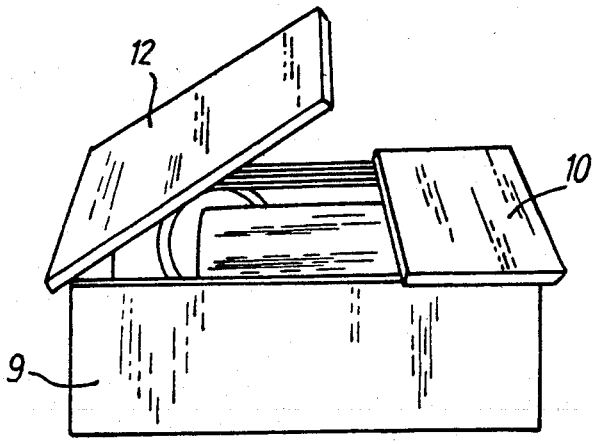

In the second movement, the assembly formed by the leg elements and the seat/back is then brought into the position of retraction inside the box, as shown in FIG. 5 and FIG. 6; the end edge 22 of the cover 12, which supports the front edge of the leg elements 3 and 3' is cleared by slightly tipping the leg elements 3, 3' rearwardly, this allowing the edge 22 to be freed and the whole of the cover 12 to be raised, as shown in FIG. 5, about pivot 23.

Figure 7:
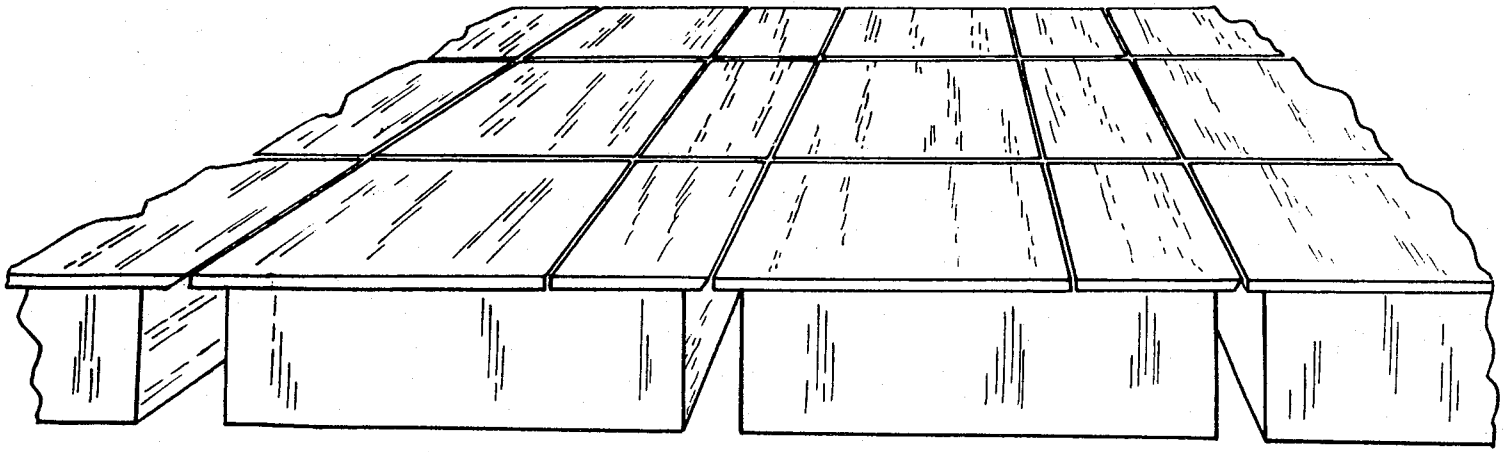
FIG. 7 shows a view in perspective of the floor of a hall equipped with the retractable chairs according to the invention, disposed in their boxes in folded position, the surface of the floor being cleared.

The assembly of the lateral leg elements 3, 3' containing the seat 1 and back 2 in compact position is then folded down about pivot 7 inside the box 9; after the seat/back/leg element assembly has been positioned in compact position, the cover 12 may be folded down as shown in FIG. 6 and it then comes edge to edge with plate 10, together forming a continuous surface which will reconstitute the whole floor of the hall with the covers and rear plates of the adjacent boxes, as shown in FIG. 7.

The movement for opening the chairs into active position is made in the opposite manner, starting from FIG. 6 to arrive in the position shown in FIG. 3.

To this end, it suffices to raise the edge 22 of the cover 12 of each box and to seize the whole of the chair and bring it into a position corresponding to FIG. 4, the leg elements being disposed vertically and resting on the end edge 22 of the cover 12; the moving apart of the seat and back then being accompanied by the lifting of the pivot pin 13 by tipping the bearing bracket 14.

What is claimed is:

1. A retractable chair, adapted to be moved between an unfolded position for receiving a sitting person and a folded position, of the type constituted by:

a box comprising a first edge and at least one cover articulated along said first edge of said box and hingedly openable so as to permit housing the retracted chair within the box;

two lateral legs, each being constituted by a panel articulated along a second edge opposite said first edge of said box, each panel being pivotable between a vertical position projecting above and outside the box, and a horizontal and retracted position inside said box;

a seat and back assembly comprising one seat and one back angularly movable with respect to each other and being hingedly mounted one on the other, said seat and back assembly further being pivotably mounted together on said lateral legs via an articulation assembly; and wherein said articulation assembly between the seat and back on the one hand, and the lateral legs on the other hand, is formed by a set of two lateral brackets, each bracket being L-shaped and comprising a first and a second arm, said bracket being fixed to the corresponding leg by a pivot pin mounted at the end of said first arm so that said first arm is movable angularly between a first unfolded position of the seat in which said first arm is in abutment parallel to the supporting leg, and a second folded position in which said first arm is substantially at right angles to said leg, the second arm of the L-shaped bracket supporting at its end the hinge between the seat and the back, so that the angular movement to fold the chair of the seat towards the back causes, by displacement of the center of gravity, the pivoting of said brackets from said first to said second position, bringing about the retraction in height of said seat and back assembly between the legs.

2. The chair as claimed in claim 1, further comprising:

a plate fixedly mounted to and joining said legs, said plate being movable with said legs between said vertical position and said horizontal position, said plate in said folded position being at the level of said cover in said closed position thereof so that said plate and said cover form in their closed position a continuous surface adapted to constitute, with the surface of the plates and the covers of a plurality of adjacent like boxes, a floor of a room, the chair of each adjacent box being housed within its respective box, in said folded position.

3. A retractable chair having an unfolded position and a folded position, said chair comprising:

a box for housing said chair in said folded position having a cover and first and second opposite edges, said cover being hinged to said box along said front edge;

two lateral legs and a first means for pivotally mounting said legs to said box along said second edge such that said legs are pivotable between a vertical position projecting outside said box and a horizontal position within said box;

a seat and a back, and pivot pin means for pivotally mounting said back to said seat for relative angular movement between open and closed positions, said pivot pin means having laterally opposite ends;

second means for pivotally mounting said seat and back to said legs comprising two lateral brackets, said brackets each having a first and a second arm, said first arm of each of said brackets being pivotally mounted to each of said legs such that said brackets are pivotal between a first position wherein said first arm of each of said brackets is generally parallel to and in abutment with each respective one of said legs and a second position wherein said first arm of each of said brackets is generally perpendicular to each respective one of said legs; and said second arm of each of said brackets having means for respectively receiving said opposite ends of said pivot pin means such that an angular movement of said seat towards said back causes the center of gravity of said seat to shift with respect to said brackets so that said brackets pivot from said first position to said second position and said back retracts downwardly between said legs.

4. The chair as claimed in claim 3, further comprising:

said box having vertically extending opposite side walls and each of said legs having a panel extending parallel with said side walls, said legs being spaced apart a distance sufficient to accommodate said seat and said back extending laterally between said legs.

5. The chair as claimed in claim 4, further comprising:

two lateral stops projecting from the surface of said back perpendicular to said panel on each of said legs, and guide surface means disposed on each said panel for cooperating with said stops such that each of said stops are movable between said open position wherein said stops abut said guide surface means to block said back against rearward movement and said closed position wherein said stops are received in a lower housing disposed at a base of the guide surface means for maintaining said seat and said back in said closed position.

6. The chair as claimed in claim 4, further comprising:

said cover having a terminal edge;

said legs having vertically opposite upper and lower ends when said legs are in said vertical position; and in said unfolded position, said lower ends of said legs being supported in part by said terminal edge of said cover and in part by said first means for pivotally mounting said legs to said box.

* * * * *